US010648122B2

(12) United States Patent
Rios

(10) Patent No.: US 10,648,122 B2
(45) Date of Patent: May 12, 2020

(54) LAUNDRY TREATING APPLIANCE AND TREATING CHEMISTRY DISPENSER

(71) Applicant: WHIRLPOOL CORPORATION, Benton Harbor, MI (US)

(72) Inventor: Marcos Javier Rios, Monterrey (MX)

(73) Assignee: Whirlpool Corporation, Benton Harbor, MI (US)

( * ) Notice: Subject to any disclaimer, the term of this patent is extended or adjusted under 35 U.S.C. 154(b) by 77 days.

(21) Appl. No.: 15/816,524

(22) Filed: Nov. 17, 2017

(65) Prior Publication Data

US 2019/0153656 A1 May 23, 2019

(51) Int. Cl.

| | |
|---|---|
| ***D06F 39/02*** | (2006.01) |
| ***D06F 33/02*** | (2006.01) |
| ***D06F 37/06*** | (2006.01) |
| ***D06F 37/22*** | (2006.01) |
| ***D06F 37/26*** | (2006.01) |

(Continued)

(52) U.S. Cl.

CPC ..... *D06F 39/028* (2013.01); *D06F 33/02* (2013.01); *D06F 37/06* (2013.01); *D06F 37/22* (2013.01); *D06F 37/266* (2013.01); *D06F 37/304* (2013.01); *D06F 37/38* (2013.01); *D06F 39/002* (2013.01); *D06F 39/005* (2013.01); *D06F 39/008* (2013.01); *D06F 39/02* (2013.01); *D06F 39/045* (2013.01); *D06F 39/085* (2013.01); *D06F 39/087* (2013.01);

(Continued)

(58) Field of Classification Search

CPC .. A47L 15/44; A47L 15/4409; A47L 15/4418; A47L 15/4436; A47L 15/4445; A47L 15/4463; D06F 39/02; D06F 39/022; D06F 39/024; D06F 39/026; D06F 39/028

See application file for complete search history.

(56) References Cited

U.S. PATENT DOCUMENTS

| | | | | |
|---|---|---|---|---|
| 9,297,106 | B2 | 3/2016 | Doh | |
| 2012/0017653 | A1* | 1/2012 | Doh | D06F 39/02 68/17 R |

(Continued)

FOREIGN PATENT DOCUMENTS

| | | | |
|---|---|---|---|
| CN | 204097753 | U | 1/2015 |
| CN | 106480664 | A | 3/2017 |

(Continued)

OTHER PUBLICATIONS

Machine Translation of Xu, CN 106480664, Mar. 2017. (Year: 2017).*

(Continued)

*Primary Examiner* — David G Cormier

(74) *Attorney, Agent, or Firm* — McGarry Bair PC

(57) ABSTRACT

A laundry treating appliance and a treating chemistry dispenser including a receptacle at least partially defined by a set of walls and a moveable barrier rotatably mounted between a closed position wherein the receptacle and moveable barrier are configured for selectively holding a liquid treating chemistry or a powder treating chemistry and an opened position where the moveable barrier is rotated and configured to allow dispensing of the liquid treating chemistry or the powder treating chemistry; and a water diverter configured to selectively divert a flow of water to the receptacle.

19 Claims, 6 Drawing Sheets

(51) Int. Cl.

| | |
|---|---|
| ***D06F 37/30*** | (2020.01) |
| ***D06F 37/38*** | (2006.01) |
| ***D06F 39/00*** | (2020.01) |
| ***D06F 39/04*** | (2006.01) |
| ***D06F 39/08*** | (2006.01) |
| ***D06F 39/12*** | (2006.01) |
| *D06F 58/20* | (2006.01) |

(52) U.S. Cl.
CPC ..... *D06F 39/088* (2013.01); *D06F 39/12* (2013.01); *D06F 39/022* (2013.01); *D06F 58/203* (2013.01)

(56) References Cited

U.S. PATENT DOCUMENTS

| | | | |
|---|---|---|---|
| 2016/0153133 | A1 | 6/2016 | Del Pos et al. |
| 2017/0159227 | A1 | 6/2017 | Jung et al. |

FOREIGN PATENT DOCUMENTS

| | | | |
|---|---|---|---|
| DE | 1325821 | A1 | 2/1995 |
| DE | 102007052076 | B3 | 1/2009 |
| EP | 0582092 | A1 | 2/1994 |
| EP | 2377988 | A2 | 10/2011 |
| GB | 2187763 | A | 9/1987 |
| KR | 101013374 | B1 | 2/2011 |
| WO | 2012085827 | A2 | 6/2012 |

OTHER PUBLICATIONS

Machine Translation of Behr et al., EP 2377988, Oct. 19, 2011. (Year: 2011).*

European Search Report for Counterpart EP18205791.9, dated March 7, 2019.

* cited by examiner

FIG.

LAUNDRY TREATING APPLIANCE AND TREATING CHEMISTRY DISPENSER

BACKGROUND

Laundry treating appliances, such as clothes washers, refreshers, and non-aqueous systems, may be a common convenience in many homes. A user simply loads the cleaning appliance with laundry to be treated into a treating chamber, along with an optional supply of a treating chemistry, such as detergents, bleach, enzymes, and anti-spotting agents and selects and initiates a cleaning cycle that is subsequently automatically carried out by the cleaning appliance. An example of a typical cleaning cycle includes the washing of the laundry with liquid and optional treating chemistry and rinsing the laundry with liquid. Cleaning appliances may be provided with a dispenser for automatically dispensing one or more treating chemistries during a cleaning cycle.

BRIEF SUMMARY

An aspect of the present disclosure relates to a treating chemistry dispenser for a laundry treating appliance, the treating chemistry dispenser comprising a receptacle at least partially defined by a set of walls and a moveable barrier rotatably mounted between a closed position wherein the receptacle and moveable barrier are configured for selectively holding a liquid treating chemistry or a powder treating chemistry and an opened position where the moveable barrier is rotated and configured to allow dispensing of the liquid treating chemistry or the powder treating chemistry and a water diverter configured to selectively divert a flow of water to the receptacle wherein the moveable barrier is configured to rotate to the opened position once the treating chemistry and water added from the water diverter into the receptacle has reached a predetermined height.

Another aspect of the present disclosure relates to a laundry treating appliance configured to execute a treating cycle on an article, comprising a cabinet defining an interior a treating chamber located within the interior and configured for receiving an article and a treating chemistry dispenser system, comprising a receptacle at least partially defined by a set of walls and a moveable barrier rotatably mounted between a closed position wherein the receptacle and moveable barrier are configured for selectively holding a liquid treating chemistry or a powder treating chemistry and an opened position where the moveable barrier is rotated and configured to allow dispensing of the liquid treating chemistry or the powder treating chemistry to the treating chamber and a water diverter configured to selectively divert a flow of water to the receptacle wherein the moveable barrier is configured to rotate to the opened position once the treating chemistry and water added from the water diverter into the receptacle has reached a predetermined height

DESCRIPTION

Aspects of the disclosure relate to a laundry treating appliance having a detergent dispenser that is capable of dispensing both liquid and powder detergent from the same receptacle or repository with reconfiguration. As the dispenser does not require alternative configurations for the liquid and powder dispensing this leads to increased user satisfaction. Further still the dispenser avoids loss of detergent prior to the beginning of the cycle as has been a problem in previous designs.

Conventionally, there have primarily been two ways in which washing machines were constructed to account for the difference between dispensing powder and liquid detergent. The first way was to construct a washing machine with separate detergent chambers for each type of detergent, liquid and powder. This was bulky and expensive to manufacture. The second way was to construct a washing machine with a single chamber that allows for liquid or powder detergent; however, prior to adding the detergent the user had to physically switch the position of a barrier between two pre-set positions to reflect what type of detergent they were planning to add. More specifically, the barrier had to be moved to make the chamber larger for powdered detergent and smaller for liquid detergents. In such a second constructions, holes and guides for aiding in positioning the barrier caused detergent loss prior to the start of the cycle.

Aspects of the present disclosure include a treating chemistry dispensing system with a repository or receptacle having a moveable wall. The moveable wall can rotate between an opened position and a closed position wherein the wall seals the receptacle to the movement of both powder and liquid treating chemistries. In this manner, the receptacle can be utilized to dispense either liquid or powder treating chemistry and avoid loss of the treating chemistry prior to the intended dispensing of the treating chemistry during the cycle of operation. Once the desired treating chemistry is added, water is then added to the receptacle. Water is added until the mixture of water and treating chemistry are high enough that the moveable barrier is caused to rotate to the opened position. After the cycle, the detergent dispensing barrier returns to a closed position by user interaction.

Figure 1:
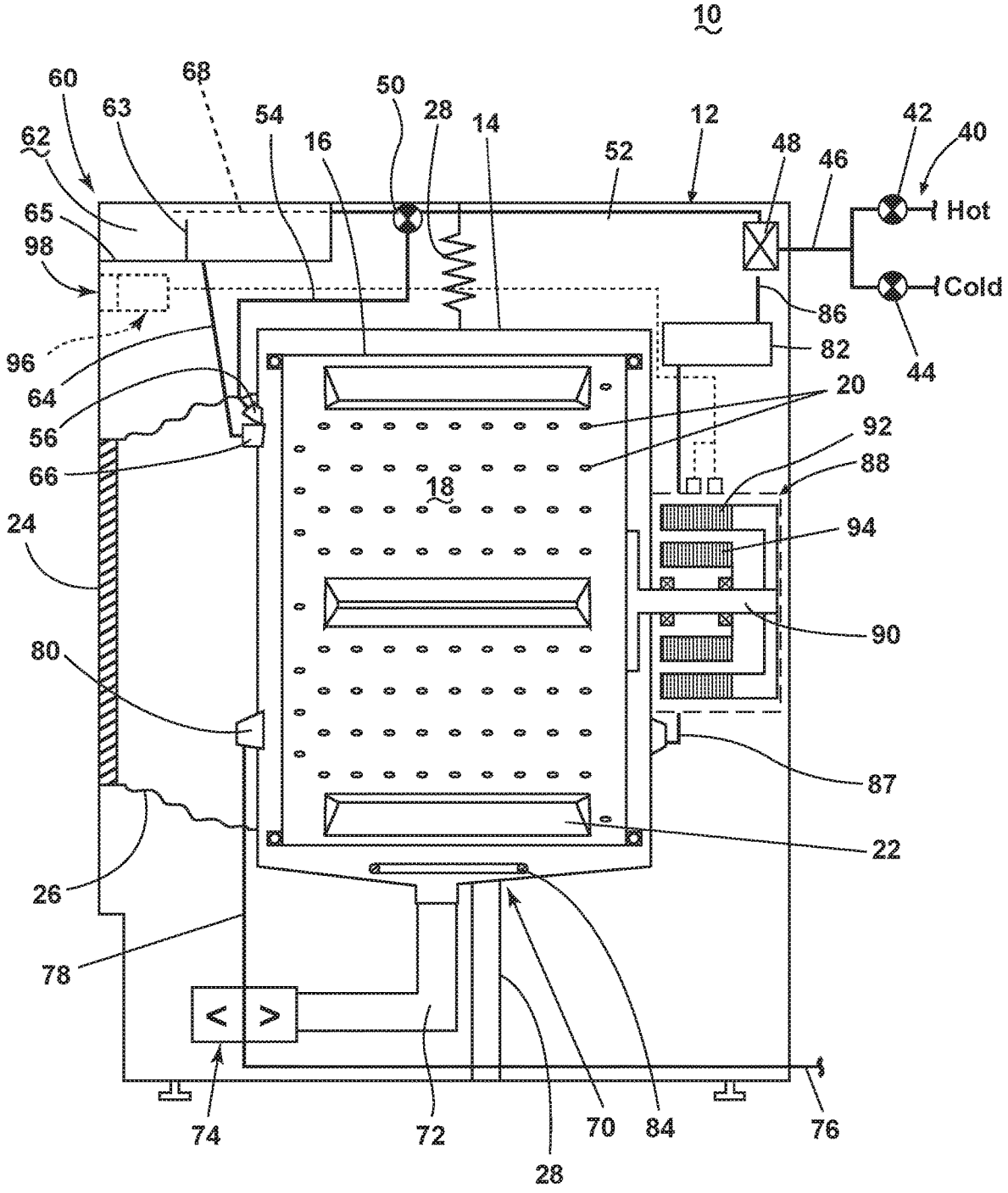
FIG. 1 is a schematic view of a laundry treating appliance in the form of a washing machine including a display according to various aspects described herein.

FIG. 1 is a schematic view of a laundry treating appliance according to aspects of the present disclosure. The laundry treating appliance may be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12, which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a drum 16 provided within the tub 14. The drum 16 defines at least a portion a laundry treating chamber 18 for receiving a laundry load for treatment. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It may also be within the scope of the invention for the laundry holding system to include only a tub with the tub defining the laundry treating chamber.

The laundry treating chamber 18 may have an open face that may be selectively closed by a cover, such as a door 24. More specifically, the door 24 may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a treating chemistry dispensing system 60 for dispensing treating chemistry to the treating chamber 18 for use in treating the laundry according to a cycle of operation. The dispensing system 60 may include at least one receptacle 62 that stores a single dose of treating chemistry that the dispensing system 60 dispenses to the treating chamber and/or the drum 16, as part of the execution of the cleaning cycle. As used herein, the term "single dose of treating chemistry" and variations thereof, refers to an amount of treating chemistry sufficient for one cleaning cycle of the automatic clothes washing machine 10. The receptacle 62 can include a set of walls including at least one moveable wall or moveable barrier 63 that together form the receptacle or repository for the treating chemistry. The receptacle 62 can be any suitable shape, size, or form including that of a cup having a moveable barrier. The receptacle 62 can be configured for dispensing liquid or powder treating chemistries indistinctly. The term indistinctly is used herein to mean without need for a change in the treating chemistry dispensing system 60. In this manner, there is no need to utilize different chambers for the liquid and powder treating chemistries and there is no need resize the chambers depending on what treating chemistry is being utilized. Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The receptacle 62 can be fixed to the cabinet 12 or slidable relative to the cabinet 12. In either case the receptacle 62 will be accessible either through the cabinet 12 or exteriorly of the cabinet 12 for refilling purposes. While not illustrated, the dispensing system 60 may also include a dispenser housing located within the cabinet 12 and underlying the receptacle 62 when the receptacle 62 may be filled and ready for dispensing.

Water may be supplied to an upper portion of the receptacle 62 from the supply conduit 52 by directing the diverter mechanism 50 to direct the flow of water to a dispensing supply conduit 68 to the receptacle 62 the resulting mixture of water and chemistry may cause the moveable barrier 63 to rotate to the opened position once the mixture reaches a predetermined height. The mixture can then be directed to the conduit 64.

The washing machine 10 may also include a recirculation and drain system for recirculating liquid within the laundry holding system and draining liquid from the washing machine 10. Liquid supplied to the tub 14 through tub outlet conduit 54 and/or the conduit 64 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as may be known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

The control system may control the operation of the washing machine 10 to implement one or more cycles of operation. The control system may include a controller 96 located within the cabinet 12 and a user interface 98 that may be operably coupled with the controller 96. The user interface 98 may provide an input and output function for the controller. The user interface 98 may include one or more knobs, dials, switches, displays, touchscreens, and the like for communicating with the user, such as to receive input and provide output. For example, the displays may include any suitable communication technology including that of a liquid crystal display (LCD), a light-emitting diode (LED) array, or any suitable display that may convey a message to the user. The user may enter different types of information including, without limitation, cycle selection, and cycle parameters, such as cycle options. Other communications paths and methods may also be included in the washing machine 10 and may allow the controller 96 to communicate with the user in a variety of ways. For example, the controller 96 may be configured to send a text message to the user, send an electronic mail to the user, or provide audio information to the user either through the washing machine 10 or utilizing another device such as a mobile phone.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It may be contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
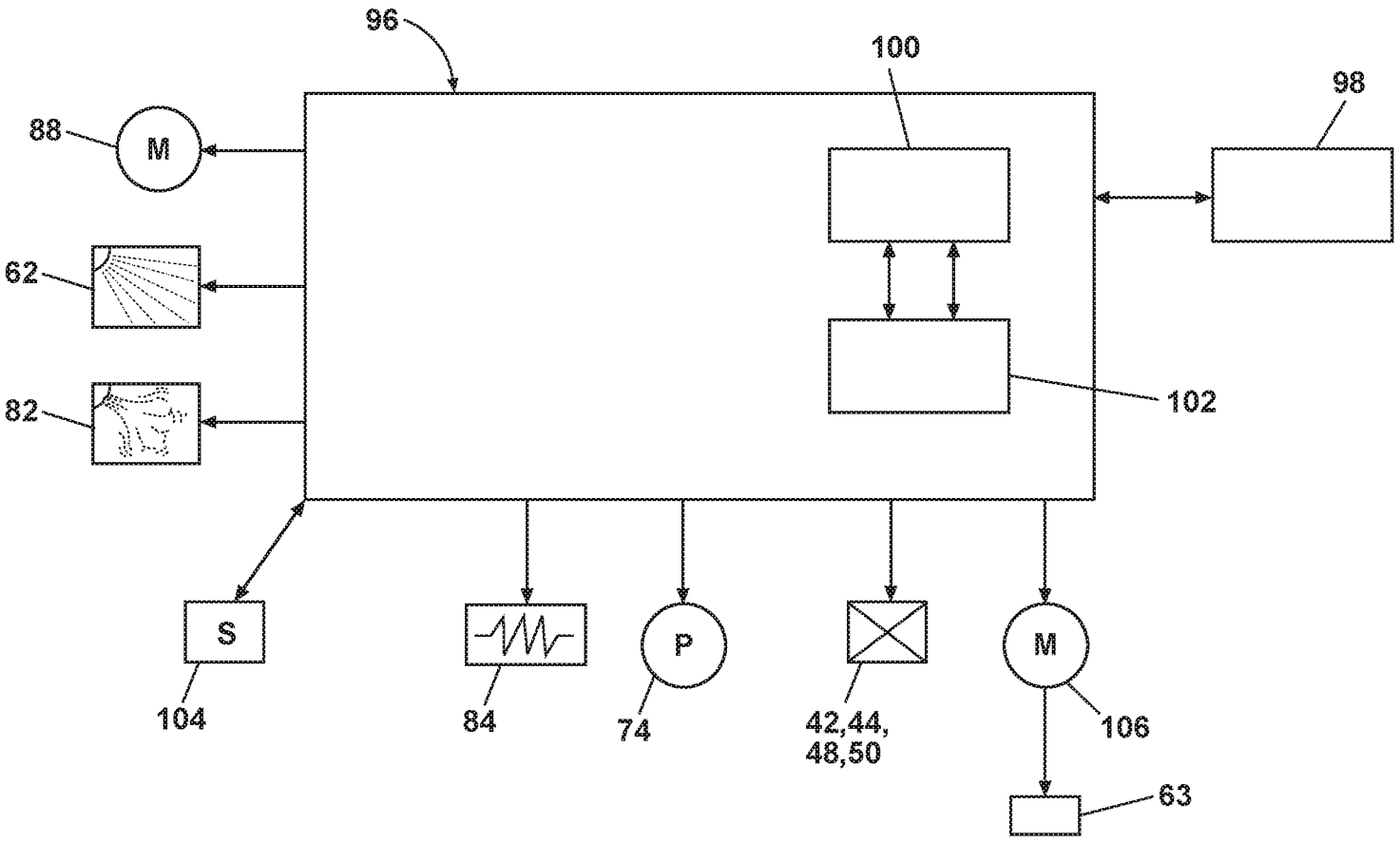
FIG. 2 is a schematic of a control system of the laundry treating appliance of FIG. 1.

As illustrated in FIG. 2, the controller 96 may be provided with a memory 100 and a central processing unit (CPU) 102. The may be used for storing the control software that may be executed by the CPU 102 in completing a cycle of operation using the washing machine 10 and any additional software. For example, the memory 100 may store a set of executable instructions 98E including at least one user-selectable cycle of operation. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the steam generator 82 and the sump heater 84 to control the operation of these and other components to implement one or more of the cycles of operation.

The controller 96 may also be coupled with one or more sensors S provided in one or more of the systems of the washing machine 10 to receive input from the sensors, which are known in the art and not shown for simplicity. Non-limiting examples of sensors S that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

Figure 3A:
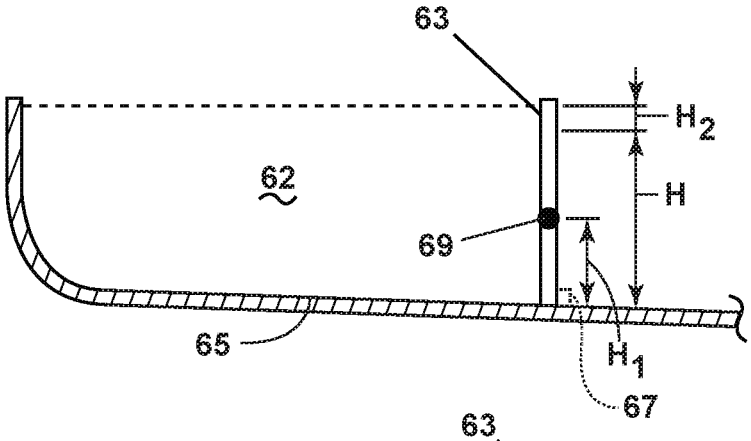
FIGS. 3A-3D schematically illustrate the operation of an exemplary portion of the dispensing system of FIG. 1.

FIG. 3A illustrates an exemplary receptacle 62 having a moveable barrier 63 that can form a portion of the treating chemistry dispensing system 60 of the washing machine 10 of FIG. 1. While the receptacle 62 has been shown in cross-section it will be understood that the receptacle 62 is formed by a set of walls including a lowermost wall 65 that join together to form a repository for treating chemistry. While any of the set of walls can be formed in any suitable manner, the lowermost wall 65 has been illustrated as having a downwards slope. The slope can have any suitable incline or decline including the illustrated two degree decline towards the conduit 64. Such a slope can aid in directing treating chemistry, water, or a mixture thereof towards the conduit 64 and the treating chamber 18. A bump-out or body can also extend from or be otherwise affixed to the lowermost wall 65 to form a stopper 67. The stopper 67 can be configured to limit movement of the moveable barrier 63.

More specifically, the moveable barrier 63 forms one portion including, but not limited to, one side of the receptacle 62. In the illustrated example, the moveable barrier 63 is illustrated as being rotatable about pivot points 69. That is the moveable barrier 63, at its opposite ends, is operably coupled to a remainder of the receptacle 62 at the pivot points 69 such that the moveable barrier 63 can rotate between an opened position and a closed position wherein the moveable barrier 63 seals the receptacle 62 from movement of both powder and liquid treating chemistries. In the closed position, the moveable barrier 63 abuts against portions of the receptacle 62 including several of walls on the sides of the moveable barrier 63 (not shown in this view) and the lowermost wall 65. In the closed position, the moveable barrier 63 may hit or otherwise be rotationally stopped by the stopper 67 such that it may only rotate in a direction away from the stopper 67.

Various measurements, dimensions, or proportions are illustrated with respect to the moveable barrier 63. For example, a height H exemplarily indicates a maximum detergent level to be added. The pivot points 69 are generally one-third the height H. The height $H_2$ indicates the height of liquid required to activate the moveable barrier 63 from the closed position towards the opened position. It will be understood that if less than a maximum amount of treating chemistry is added into the receptacle 62 that additional liquid may need to be added to the receptacle 62 to reach the height $H_2$.

Figure 3B:
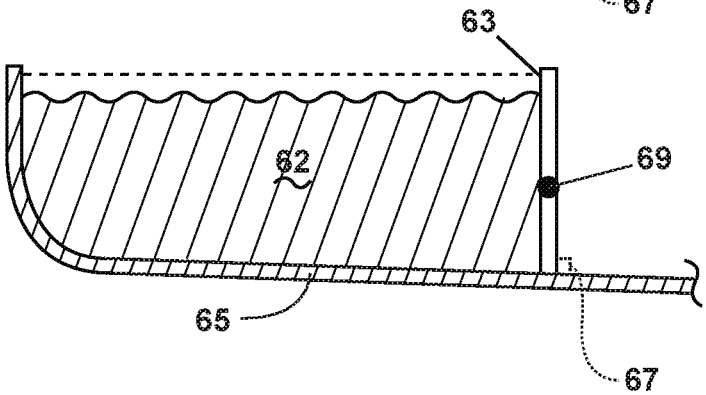

FIG. 3B schematically illustrates treating chemistry having been added to the receptacle 62 up to approximately the height H. The moveable barrier 63 is in its normally closed position and contain the detergent acting as a dam. It will be understood that while liquid detergent has been illustrated that the receptacle 62 can also be utilized for powdered treating chemistry in this configuration too.

Figure 3C:
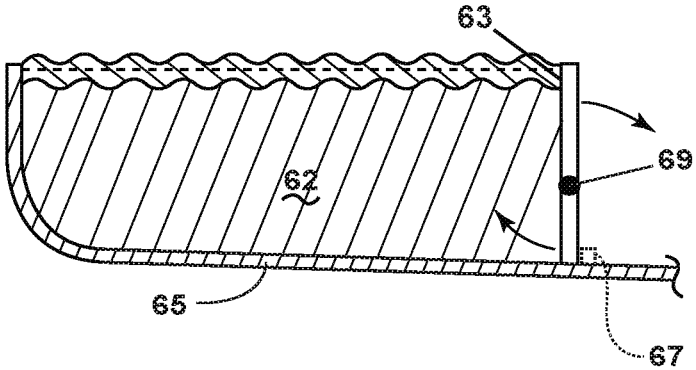
Figure 3D:
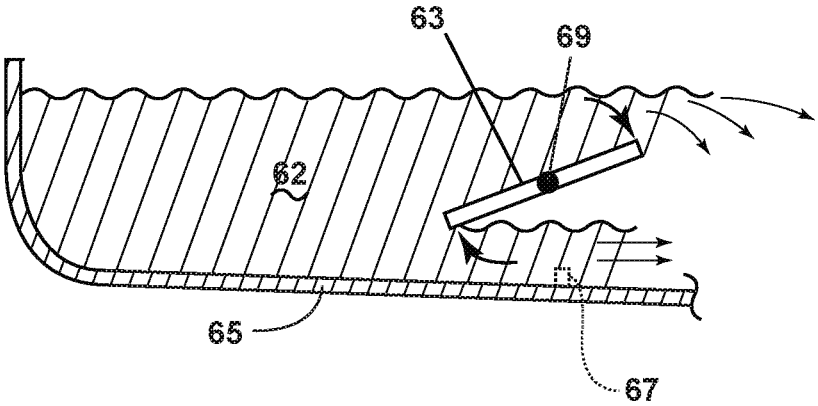

FIG. 3C schematically illustrates additional liquid, such as water, being added to the receptacle 62 up to approximately the height $H_2$ such as by the dispensing supply conduit 68. Once the predetermined height $H_2$ is reached, the moveable barrier 63 will rotate (see arrows for rotational direction). The mixture of water and treating chemistry will exit the receptacle as shown in FIG. 3D. It is contemplated that water can continue to be added to the receptacle, such as via the dispensing supply conduit 68, to continue to flush the treating chemistry out of the receptacle 62. The flushing of the treating chemistry from the receptacle 62 may be accomplished in any suitable manner. Upon leaving the receptacle 62, the mixture may enter the tub 14 via the conduit 64 and an optional dispensing nozzle 66 configured to dispense the treating chemistry into the tub 14 in a desired pattern and under a desired amount of pressure.

After the cycle of operation or the dispensing is complete it is contemplated that a user can return the moveable barrier 63 back to the closed position. More specifically, a user can rotate the moveable barrier 63 in an opposite rotation until it abuts the optional stopper 67. Alternatively, an actuator 106 (FIG. 2) can be operably coupled to the moveable barrier 63 and the actuator 106 can return the moveable barrier 63 to the closed position. While the actuator 106 can be any suitable actuator it is contemplated that a motor coupled to the controller 96 can be configured to return the moveable barrier 63 to the closed position.

It is contemplated that the treating chemistry dispensing system 60 can include any suitable chamber configured to dispense liquid or powder detergent and having a barrier that moves or rotates to release detergent in response to the detergent level exceeding a predetermined height. By way of additional non-limiting example, the dispensing system 60 may be fixed within the cabinet 12 and have a moveable door, hatch, access panel, or other access mechanism for access to it. Alternatively, FIG. 4. illustrates that the dispensing system 60 may be implemented in a drawer-type system included in the washing machine of FIG. 1. More specifically, the dispensing system 60 shown includes a lower dispenser housing 112, an upper dispenser housing 114 (shown in phantom), a dispenser drawer 116, a dispenser drawer handle 118, and a cup cover 120. The dispenser drawer 116 has been illustrated as housing the receptacle 62 and several other cups 130, 132 (FIG. 5) although this need not be the case.

Figure 4:
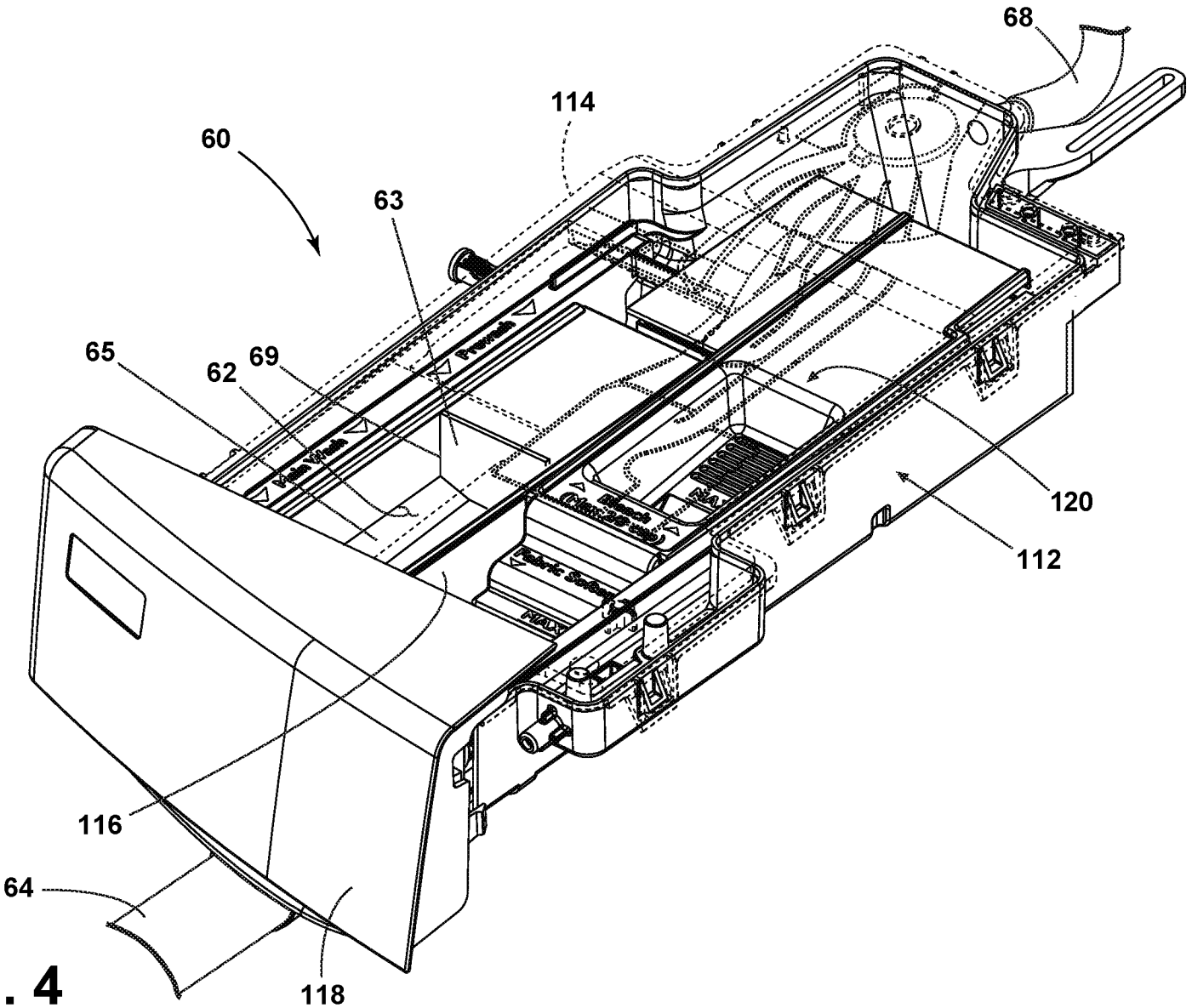
FIG. 4 is a perspective view of an exemplary dispensing system in the laundry treating appliance of FIG. 1 with a drawer in a closed position.

The lower dispenser housing 112 may be located within the cabinet 12 and underlying the dispenser drawer 116 when the dispenser drawer 116 sits in a closed position as illustrated in FIG. 4. The upper dispenser housing 114 may be located within the cabinet 12 and overlying the dispenser drawer 116 when the dispenser drawer 116 sits in a closed position. The water supply 40 via the dispensing supply conduit 68 may be fluidly coupled to either of the dispenser drawer 116 or the lower dispenser housing 112 via the upper dispenser housing 114 and a water diverter 126, which may be operably controlled by the controller 96. Further, either of the dispenser drawer 116 or the lower dispenser housing 112 may be fluidly coupled to the drum 16 (FIG. 1) via the lower dispenser housing 112 and the conduit 64.

Figure 5:
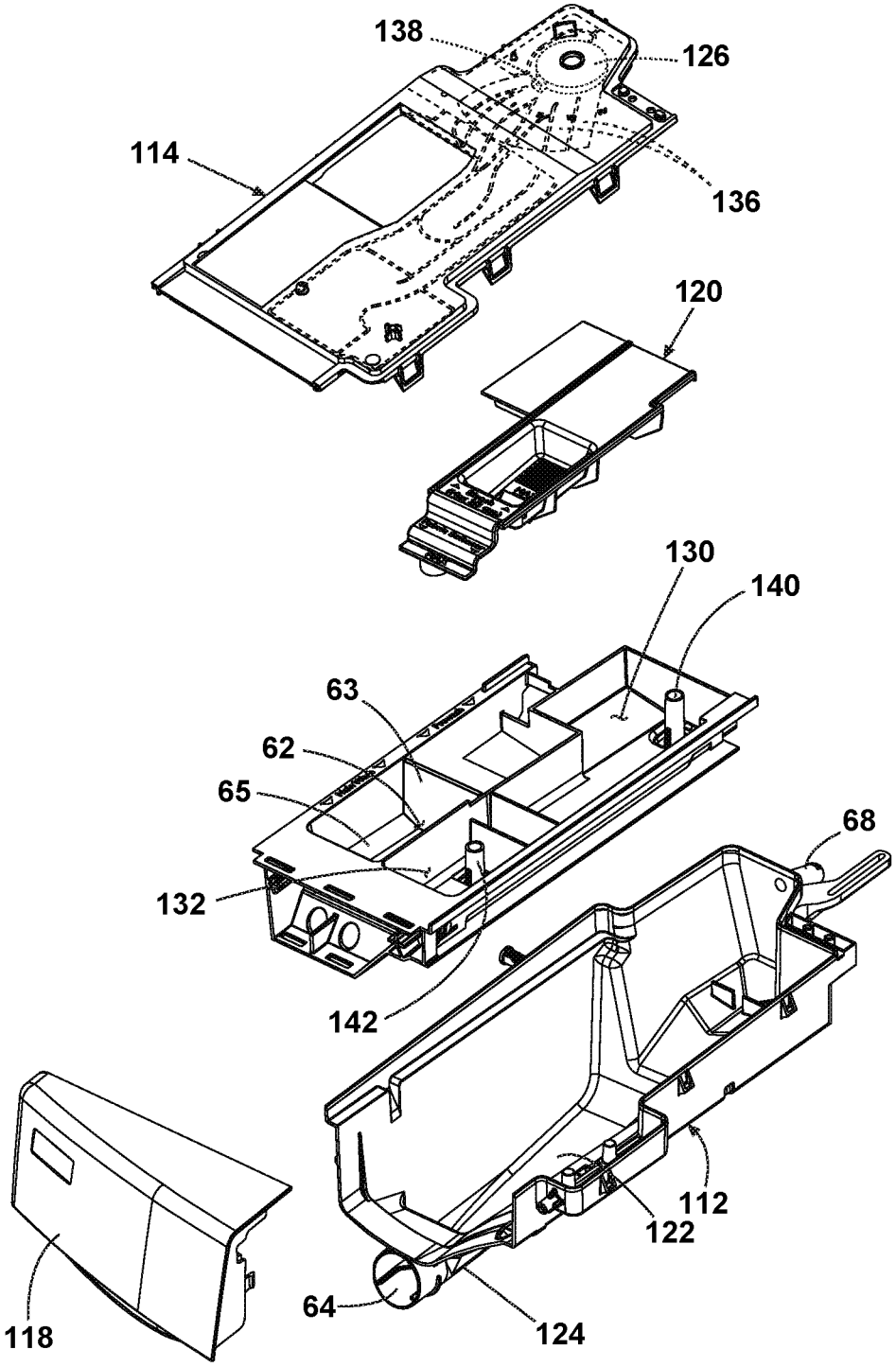
FIG. 5 is an exploded view of the dispensing system illustrated in FIG. 4.
Figure 6:
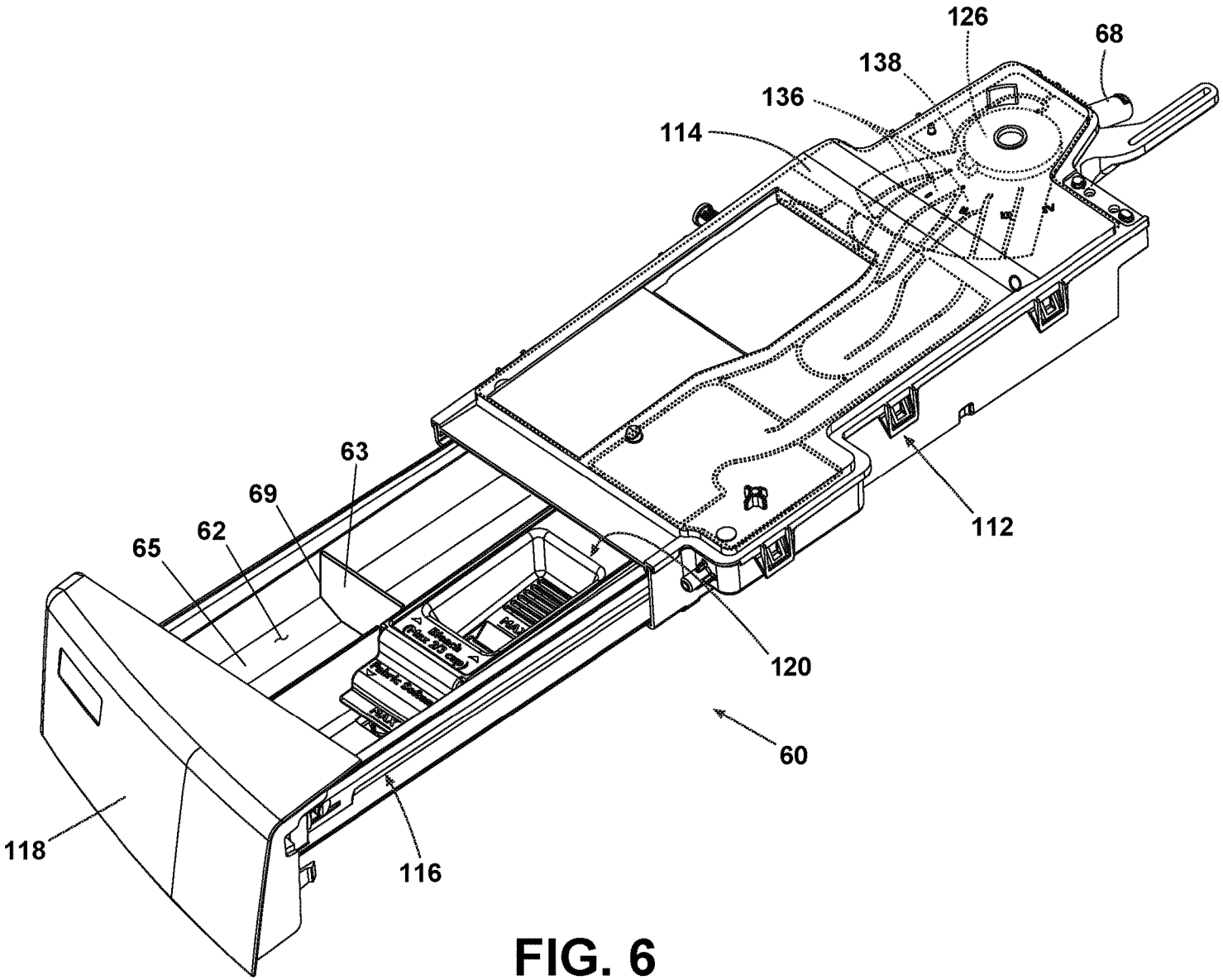
FIG. 6 is a perspective view of the exemplary dispensing system of FIG. 4 with the drawer in an opened position.

The structure of the treating chemistry dispensing system 60 will be described in greater detail with regard to FIG. 5, which illustrates an exploded view of the dispensing system 60 of FIG. 4. The lower dispenser housing 112 may have a sloped bottom wall 122. An outlet port 124 may be located at the front of the sloped bottom wall 122. The outlet port 124 fluidly couples the drum 16 through the conduit 64.

As illustrated, the dispenser drawer 116 defines a portion of the receptacle 62 having the moveable barrier 63 and fluidly coupled to the treating chamber 18. More specifically, the dispenser drawer 116 defines the set of walls including the lowermost wall 65 of the receptacle 62. The moveable barrier is pivotably coupled at the pivot points 69 to dispenser drawer 116 and is typically in a closed position where the moveable barrier abuts against a remainder of the dispenser drawer 116 to stem a flow of treating chemistry from the receptacle 62.

The dispenser drawer 116 may include additional dispensing chambers, and is illustrated with additional dispensing chambers 130, 132 that act as treating chemistry reservoirs or compartments that may hold liquid or powdered treating chemistry, such as laundry detergent, fabric softener, bleach, and the like. The dispenser drawer 116 fluidly couples to the lower dispenser housing 112 such that when any of the additional dispensing chambers 130, 132 are flushed with water from the supply 32, the resulting mixture of water and chemistry may be dispensed to the lower dispensing housing 112, where it may be carried by conduit 64 to the drum 16.

In the embodiment shown, the cup cover 120 when inserted into the dispenser drawer 116 overlies a portion of the dispenser drawer 116 and more specifically overlies at least a portion of dispensing chambers 130 and 132. The cup cover 120 hides siphon posts 140, 142 of the additional dispensing chambers 130, 132. The siphon posts 140, 142 are fluidly coupled to the lower dispenser housing 112. When the chambers 130, 132 are flushed with water, the mixture of water and chemistry will be siphoned into the lower dispensing housing 112 through the siphon posts 140, 142. In this manner the dispenser drawer 116 includes at least one dispensing cup having a dispenser siphon configured to remove liquid from the dispensing cup.

The upper dispenser housing 114 may be formed such that water paths 136 may be located in its interior. Water entering the upper dispenser housing 114 from the dispensing supply conduit 68 may be supplied to the water diverter 126 and may be directed through a water diverter outlet 138 into one of several different water paths 136, formed internally in the upper dispenser housing 114, to various portions of the lower dispenser housing 112 and to various portions of the dispenser drawer 116. The water may then flush any treating chemistry therein to form a mixture, which may then travel through the outlet port 124 in the lower dispenser housing 112, through the conduit 64, and into the drum 16.

The water diverter 126, and thus the water diverter outlet 138, may be operably coupled with the controller 96. Thus the water diverter 126, operated by the controller 96, may operate to selectively control the fluid coupling of the water diverter outlet 138 with different water paths 136. The water diverter 126, operated by the controller 96, may divert a flow of water through one of the different water paths 136 to the receptacle 62 as well as through other of the water paths 136 to the additional dispensing chambers 130, 132.

The dispenser drawer 116 may be slidably mounted to the lower dispenser housing 112 for slidable movement between an opened position (FIG. 5), where the receptacle 62 and the additional dispensing chambers 130, 132 may be accessible exteriorly of the cabinet 12, and a closed position (FIG. 3), where the receptacle 62 and the additional dispensing chambers 130, 132 may be within the cabinet 12. The dispenser drawer handle 118 may be used to effect the movement of the dispenser drawer 116.

Once a user has added in the desired amount of liquid or powdered treating chemistry into the receptacle 62 with the moveable barrier 63 in the closed position, the dispenser drawer 116 can be moved to the closed position. At the appropriate time during the cycle of operation, water may be supplied into the receptacle 62 via the water diverter 126, which may be operably controlled by the controller 96. When the water in combination with the detergent is at the predetermined height required to activate the moveable barrier 63, then the moveable barrier 63 rotates from the closed position to the opened position and the moveable barrier 63 no longer seals or abuts against the lower most wall of the dispenser drawer 116 and no longer prohibits or prevents the outflow of the mixture of treating chemistry and water. In this manner, the moveable barrier 63 is caused to rotate to the opened position based on the mixture in the receptacle exceeding a predetermined level or height.

The mixture of the treating chemistry and water travels along the lowermost wall 65 to the lower dispenser housing 112 to flush the treating chemistry to the treating chamber 18 through conduit 64. In this way, the lower dispenser housing 112 and the conduit 64 may be described as forming a conduit to the treating chamber 18. Any suitable amount of water may be introduced to the receptacle 62 once the moveable barrier 63 has moved to the opened position to flush the remainder of treating chemistry or mixture of treating chemistry and water from the receptacle 62.

After the cycle of operation, the moveable barrier 63 can be returned to the closed position by a user. It is contemplated, that an optional stopper (not shown) can be included in the receptacle 62 and can prevent movement of the moveable barrier 63 past the closed position. More specifically, the stopper can prevent over-rotation of the moveable barrier 63, by a user, beyond the closed position. As yet another alternative, an actuator 106 (FIG. 2) can be operably coupled to the moveable barrier 63 and may be configured to return the moveable barrier 63 to the closed position. For example, such an actuator 106 could be motor controlled by the controller 96 and operable to rotate the moveable barrier 63 from the opened position to the closed position at the end of the cycle of operation or after dispensing from the receptacle 62.

While the previously described dispenser was described in a laundry treating appliance in the environment of a horizontal axis automatic clothes washing machine 10 it will be understood that the dispenser can have utility in other environments, including other cleaning appliances, especially in dishwashers or vertical axis washing machines.

A benefit of the present disclosure is that the receptacle can be utilized to dispense either liquid or powder treating chemistry and avoid loss of the treating chemistry prior to the intended dispensing of the treating chemistry during the cycle of operation. Once the desired treating chemistry is added, water is then added to the receptacle during the specified period of the cycle of operation. Water is added until the mixture of water and treating chemistry are high enough that the moveable barrier is caused to rotate to the opened position.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. While not illustrated herein it is contemplated that bulk dispensing functionality can be added to the single-use dispensing system by the addition of a bulk dispensing cartridge or a bulk dispensing tank and a metering device that can meter an amount into any of the dispenser cups including into the receptacle with the moveable barrier. Such bulk dispensing cartridges or a bulk dispensing tank may store multiple doses of treating chemistry because the treating chemistry it stores may be of a higher concentration than normally required for a single use dispensing cup and/or it may be of larger volume than the portion of the dispensing cup used to hold treating chemistry.

What is claimed is:

1. A laundry treating appliance configured to execute a treating cycle, comprising:

a cabinet defining a cabinet interior;

a treating chamber located within the cabinet interior and configured for receiving an article; and a treating chemistry dispenser system, comprising:

a receptacle have an interior at least partially defined by a set of walls including a first side wall, a second side wall that is spaced from the first side wall, and a bottom wall extending therebetween, and a moveable wall defined by a planar element having a length that spans between the first side wall and the second side wall and wherein the moveable wall is rotatably mounted at a pivot point to at least one of the first side wall or the second side wall, the moveable wall rotatable between a closed position wherein the receptacle and moveable wall are configured for selectively holding a liquid treating chemistry or a powder treating chemistry and an opened position where the moveable wall is rotated away from the bottom wall and configured to allow dispensing of the liquid treating chemistry or the powder treating chemistry to the treating chamber; and a water diverter configured to selectively divert a flow of water into the receptacle, the flow of water within the interior of the receptacle configured to provide pressure on an upper portion of the planar element defining the moveable wall and rotate the upper portion of the planar element defining the moveable wall about the pivot point and away from the receptacle to the opened position once any treating chemistry and the flow of water added from the water diverter into the interior of the receptacle has reached a predetermined height above the pivot point.

2. The laundry treating appliance of claim 1 wherein the pivot point is located at one-third of a total height of a maximum treating chemistry level as defined by the moveable wall.

3. The laundry treating appliance of claim 1 wherein the moveable wall abuts the set of walls to create a barrier against liquid flow from the receptacle.

4. The laundry treating appliance of claim 1 wherein the bottom wall has a downward slope.

5. The laundry treating appliance of claim 4 wherein the downward slope is at least two degrees.

6. The laundry treating appliance of claim 4 wherein the bottom wall further comprises a stopper extending from its upper surface and wherein the stopper is configured to prevent over-rotation of the moveable wall.

7. The laundry treating appliance of claim 1 wherein the treating chemistry dispenser system further comprises a drawer that is fluidly coupled to the treating chamber, where the drawer is configured to be slidably moveable between an opened position, where the receptacle is accessible exteriorly of the cabinet, and a closed position, where the receptacle is within the cabinet.

8. The laundry treating appliance of claim 1 wherein the water diverter is configured to provide water near an uppermost portion of the receptacle.

9. The laundry treating appliance of claim 1 wherein the treating chemistry dispenser system further comprises an access panel moveable between an opened position, where the receptacle is accessible, and a closed position, where the receptacle is inaccessible by a user.

10. The laundry treating appliance of claim 1, further comprising an actuator operably coupled to the moveable wall and configured to automatically return the moveable wall to the closed position.

11. A treating chemistry dispenser for a laundry treating appliance, the treating chemistry dispenser comprising:

a water diverter configured to selectively provide water to the treating chemistry dispenser; and a receptacle at least partially defined by a set of walls and a moveable barrier defined by a planar element that is mounted at a pivot point of the moveable barrier between at least two of the set of walls, an entire body of the planar element is pivoted about the pivot point between a closed position wherein the receptacle and moveable barrier are configured for selectively holding a liquid treating chemistry or a powder treating chemistry and an opened position wherein upon pivoting of the entire body of the planar element about the pivot point an upper portion of the moveable barrier is pivoted downwards and a lower portion of the moveable barrier is pivoted upwards into the receptacle to allow for dispensing the liquid treating chemistry of the powder treating chemistry along a bottom wall from the receptacle, wherein the planar element is automatically configured to pivot from a pressure on the planar element of the water and any of the liquid treating chemistry or the powder treating chemistry located in the receptacle above a predetermined height, the predetermined height above the pivot point of the moveable barrier.

12. The treating chemistry dispenser of claim 11 wherein the moveable barrier includes a wall.

13. The treating chemistry dispenser of claim 12 wherein the pivot point is located at one-third of a total height of a maximum treating chemistry level as defined by a height of the moveable barrier.

14. The treating chemistry dispenser of claim 11 wherein the moveable barrier abuts the receptacle to create a barrier against liquid flow from the receptacle.

15. The treating chemistry dispenser of claim 11 wherein the bottom wall has a downward slope.

16. The treating chemistry dispenser of claim 15 wherein the downward slope is at least two degrees.

17. The treating chemistry dispenser of claim 15 wherein the bottom wall further comprises a stopper extending from its upper surface and wherein the stopper is configured to prevent over-rotation of the moveable barrier.

18. The treating chemistry dispenser of claim 11 wherein the water diverter is configured to provide the water near an uppermost portion of the receptacle.

19. The treating chemistry dispenser of claim 11, further comprising an access panel moveable between an access panel opened position, where the receptacle is accessible, and an access panel closed position, where the receptacle is inaccessible by a user.

* * * * *